US005503398A

United States Patent [19]

Lu

[11] Patent Number: 5,503,398

[45] Date of Patent: Apr. 2, 1996

[54] GOLF BALL

[76] Inventor: Clive S. Lu, 282 Newbridge Rd., Hicksville, N.Y. 11801

[21] Appl. No.: 309,310

[22] Filed: Sep. 20, 1994

[51] Int. Cl.[6] ..... A63B 37/14

[52] U.S. Cl. ..... 273/232

[58] Field of Search ..... 273/235 A, 232; D21/205; 40/327

[56] References Cited

U.S. PATENT DOCUMENTS

| | | | |
|---|---|---|---|
| 922,773 | 5/1909 | Kempshall | 273/232 |
| 1,666,699 | 4/1926 | Hagen | 273/232 |
| 1,948,292 | 2/1934 | Geer | 273/235 A |
| 4,681,323 | 7/1987 | Alaki et al. | 273/232 |
| 4,787,638 | 11/1988 | Kobayashi | 273/232 |
| 5,356,150 | 10/1994 | Lavallee | 273/232 |

*Primary Examiner*—George J. Marlo
*Attorney, Agent, or Firm*—King & Schickli

[57] ABSTRACT

A golf ball is provided including a body having a cover with a generally spherical outer surface. A plurality of dimples are disposed on the cover. Each dimple includes a sidewall and a bottom wall. A plurality of scales project inwardly from the sidewall of each dimple.

8 Claims, 1 Drawing Sheet

GOLF BALL

TECHNICAL FIELD

The present invention relates generally to the field of golf and, more particularly, to an improved dimple design for a golf ball especially adapted to improve directional control as well as increase lift and resulting flight distance.

BACKGROUND OF THE INVENTION

Golf is a skill sport wherein the constant goal is a level of improved play. Such a level may be achieved in two ways. The first is by improving the ability and skill of the individual golfer and the second is by improving the performance of the equipment including not only the golf clubs but also golf balls. This invention relates to the desire to provide improved golf balls exhibiting enhanced performance characteristics including better directional stability and control while also providing increases in the lifting force and overall flight distance.

The desire to provide golf balls exhibiting enhanced performance characteristics and, accordingly, a competitive edge has been a driving force in golf ball design for years. Improvements in the design of golf balls include, but are not limited to, the development of "two piece" and "three piece" golf balls, cut proof covers and various dimple designs. Despite a large number of specific advances made over the years, however, further improvements in performance are still desired and are possible.

SUMMARY OF THE INVENTION

Accordingly, it is a primary object of the present invention to provide an improved dimple design for a golf ball that may be readily formed in state of the art golf ball cover materials in an efficient and cost effective manner.

Yet another object of the present invention is to provide a golf ball exhibiting improved performance characteristics including better directional stability and control as well as increases in lift and flight distance. Further, the unique dimple design of the golf ball may be readily incorporated in golf balls of two or three piece construction to meet the individual preferences and needs as well as match the skill level of the golfer.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved golf ball is provided. The golf ball includes a body of any appropriate design known in the art including, for example, two piece or three piece construction. The body includes a cover constructed from any appropriate material known in the art including both natural and man-made materials. The cover has a generally spherical outer surface.

A plurality of dimples are disposed as depressions or cavities on the spherical outer surface of the cover. Each of the dimples includes a sidewall and a bottom wall. A plurality of scales are provided along the sidewall of the dimple projecting inwardly. More preferably, each of the dimples are oblong in shape or elliptical in shape having two foci spaced apart a distance A where $0<A<2.5$ inches and an eccentricity E where $0<E<1$. Still more preferably, each dimple has a width between 0.001–0.5 inches, a length between 0.001–0.5 inches and a a depth between 0.001–0.3 inches. Still more preferably the plurality of scales are arranged as overlapping cascade layers. Between 2–4 layers of scales are provided along the sidewall. Each scale has a width between 0.001–0.5 inches.

In accordance with yet another aspect of this invention the sidewall of each dimple includes a generally arcuate surface having a radius of curvature or curvatures at a minimum of 0.001 inches. As should further be appreciated, the sidewall defines an airfoil shape in cross-section from a first point on the outer edge of the dimple to a second point at the intersection of the sidewall and the bottom wall when viewing in a plane perpendicular to the sidewall at the first and second points and above a baseline connecting the first and second points.

Further, it should be appreciated that the baseline connecting the first and second points forms an included angle of between 15°–97° with a chord passing through the center of the golf ball. It is this airfoil shape that advantageously functions to improve the directional stability and lift provided thereby increasing accuracy and flight distance for any given golf shot relative to a golf ball of state of the art design.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE PRESENT INVENTION

Figure 1:
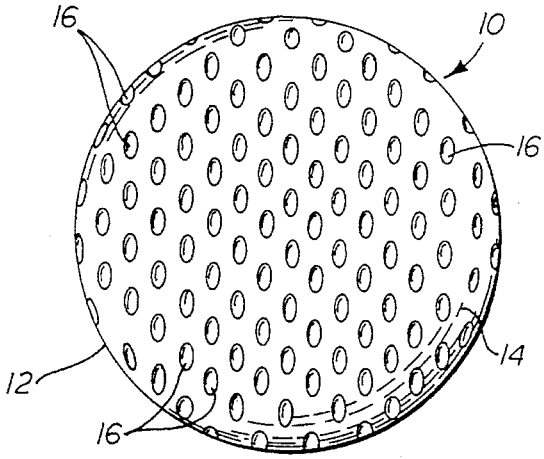
FIG. 1 is a perspective view of the golf ball constructed in accordance with the teachings of the present invention.

Reference is now made to FIG. 1 generally showing the golf ball 10 of the present invention. The golf ball 10 includes a body 12 of any appropriate construction known in the art including the well known "two piece" and "three piece" construction. The body 12, of course, also includes a cover 14 having a generally spherical outer surface. Preferably the cover 14 is constructed from balata or some man-made material suitable for this purpose such as Surlyn material as manufactured and sold by E.I. DuPont De Nemours and Company.

As also shown in FIG. 1, a plurality of dimples 16 are disposed on the spherical outer surface of the cover 14. The dimples 16 may be arranged randomly or in a pattern over the entire surface of the cover 14 again, in any manner known in the art.

Figure 2:
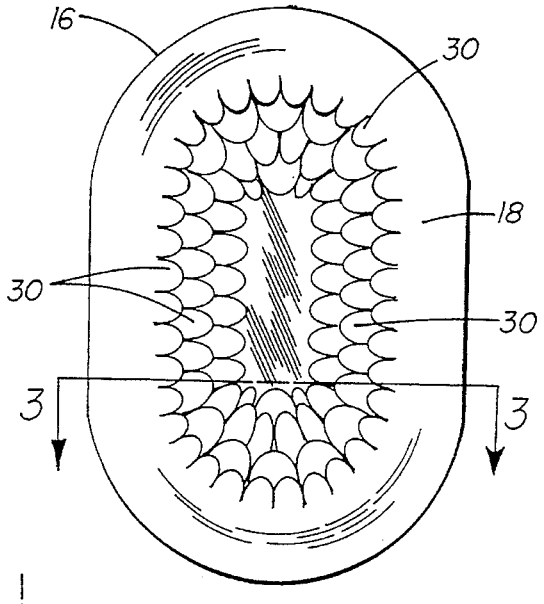
FIG. 2 is a detailed top plan view of a dimple of oblong shape utilized in the construction of the golf ball of the present invention.
Figure 3:
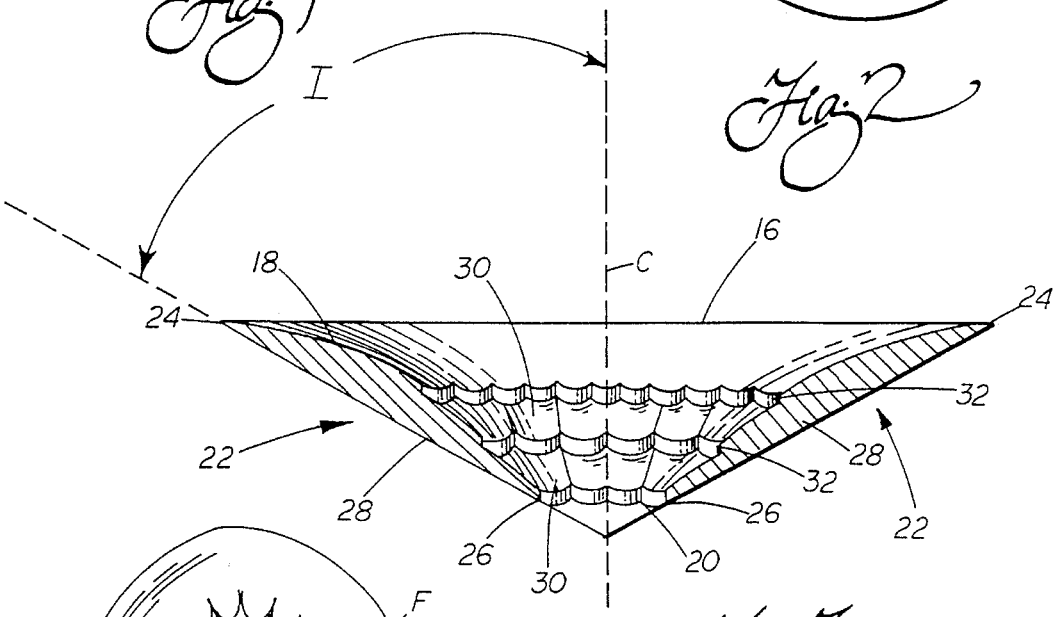
FIG. 3, is a cross-sectional view along line 3—3 of FIG. 2 showing the shape of the surface of the sidewall presented by the dimple shown in FIG. 2.
Figure 4:
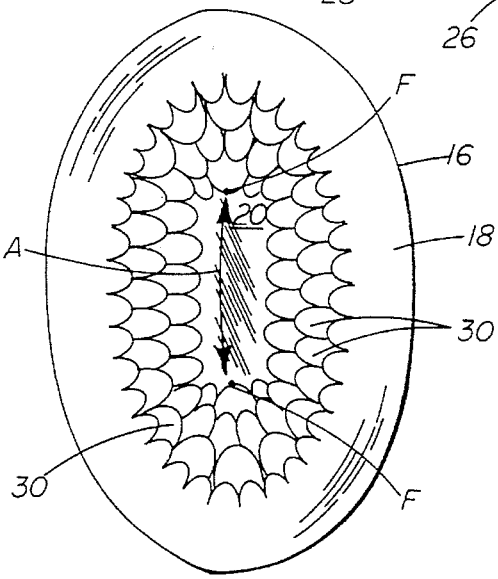
FIG. 4 is a detailed top plan view similar to FIG. 2, but showing a dimple having an alternative, elliptic shape.

Reference is now made specifically to FIGS. 2–4 showing the unique construction of the dimples 16 presented on the golf ball 10 of the present invention. In accordance with the showing in FIG. 2, each dimple 16 may be oblong in shape. Alternatively, as shown in FIG. 4, each dimple 16 may be substantially elliptical in shape, having two foci spaced apart a distance of A where $0<A<2.5$ inches and an eccentricity E where $0<E<1$. Whether oblong or elliptical in shape, each dimple 16 has a width between 0.001–0.5 inches, a length between 0.001–0.5 inches and a a depth between 0.001–0.3 inches.

As should be further appreciated from reviewing FIGS. 2 and 3, each dimple 16 includes a sidewall 18 and a bottom wall 20. Sidewall 18 generally includes an arcuate surface so as to define an airfoil shape (generally designated 22 in FIG. 3) in cross-section from a first point 24 on the outer edge of the dimple to a second point 26 at an intersection of the sidewall 18 and bottom wall 20 in a plane perpendicular to the sidewall at the first and second points above a baseline 28 connecting the first and second points. As should further be appreciated, the baseline 28 forms an included angle I of between 15°–97° with a chord C passing through the center of the golf ball 10.

As should further be appreciated, the airfoil shape 22 is accentuated by providing a plurality of scales 30 on the sidewall 18. Preferably, the plurality of scales 30 are arranged as overlapping cascade layers 32, 3–4 layers being shown in the dimple 16 of FIG. 2. Each scale 30 has a width of between 0.001–0.5 inches.

Advantageously, the golf ball 10 of the present invention functions to provide the golfer with a number of significant benefits including increased directional stability and control for more accurate shot making and increased lift to generate further flight distance and longer shots. As should be appreciated, the included angle I defines an attack angle that may be varied during the manufacturing process to provide the desired or optimal spin rate and trajectory to the golf ball. In fact, it is even possible to match the attack angle of the golf ball to a particular golfer's needs based upon his/her swing pattern, generation of club head speed and even the weather conditions. Together all of these factors determine the amount of lift generated by the golf ball 10.

After striking, the golf ball 10 travels through the air. No matter the orientation of any particular dimple 16 relative to the direction of travel of the golf ball 10, the air contacting the surface of the cover 14 initially cascades down the scales 30 along one portion of the sidewall 18, reaches the bottom wall 20 and then must travel up and over a mirror image of the same airfoil shape 22. Stated another way, the air must travel over the scales 30 of sidewall 18 along opposite portions of the dimple 16. As the air enters the dimple 16 and travels over the scales 30 down the sidewall 18 toward the bottom wall 20, an air vortex is generated. This air vortex then engages the scales 30 of the mirror-image or reverse air foil 22 on the opposing portion of the sidewall 18 causing some gradual disbursement of the air vortex.

It should further be appreciated that as the air vortex is contained in the dimple 16, it is carried by the sidewalls 18 and set in motion in the direction of spin of the golf ball 10. As the air vortex moves up the opposing sidewall 18 and disperses, it meets and collides with the air stream running over the cover 14 adjacent the dimple 16, producing a counter vortex that helps create lift as well as directional stability. As a result of the unique design of the dimples 16, the lift generated exceeds that generated by golf balls of conventional design.

In summary, numerous benefits result from employing the concepts of the present invention. The golf ball 10 includes dimples 16 of unique design incorporating a sidewall 18 with cascading layers of scales 30 forming a uniquely arcuate, air foil-like surface presented at an appropriate attack angle to generate superior lift. Directional stability is also advantageously enhanced. Accordingly, both shot distance and accuracy are improved. Further, it should be appreciated that the attack angle may be selected to meet the requirements of the individual golfer under virtually any weather conditions.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with breadth to which they are fairly, legally and equitably entitled.

I claim:

1. A golf ball comprising:

a body including a cover having a generally spherical outer surface;

a plurality of dimples disposed on said spherical outer surface of said cover, each of said dimples including a sidewall and a bottom wall, said sidewall defining an airfoil shape in cross section from a first point on an outer edge of said dimple to a second point at an intersection of said sidewall and said bottom wall in a plane perpendicular to said sidewall at said first and second points above a baseline connecting said first and second points; and a plurality of scales projecting inwardly from said sidewall of each dimple.

2. The golf ball set forth in claim 1, wherein each of said dimples is oblong.

3. The golf ball set forth in claim 1, wherein each of said dimples is elliptical having two foci spaced apart a distance A where $0<A<2.5$ inches and an eccentricity E where $0<E<1$.

4. The golf ball set forth in claim 1, wherein said plurality of scales are arranged as overlapping cascade layers.

5. The golf ball set forth in claim 4, including between 2–4 layers of scales, each scale having a width between 0.001–0.5 inches.

6. The golf ball set forth in claim 1, wherein each dimple has a width between 0.001–0.5 inches, a length between 0.001–0.5 inches and a a depth between 0.001–0.3 inches.

7. The golf ball set forth in claim 1, wherein said sidewall includes an arcuate surface.

8. The golf ball set forth in claim 1, wherein said baseline forms an included angle of between 15°–97° with a chord passing through a center of the golf ball.

* * * * *